US008113318B2

(12) United States Patent
Monzon et al.

(10) Patent No.: US 8,113,318 B2
(45) Date of Patent: Feb. 14, 2012

(54) ELEVATOR MACHINE WITH INTEGRATED BRAKE SURFACE

(75) Inventors: Andres Monzon, Madrid (ES); Jose Miguel Aguado, Madrid (ES); Juan Manuel Oronoz, Guipuzcoa (ES); Juan Martin, Madrid (ES); Antonio Sanchez, Madrid (ES); Jose Sevilleja, Madrid (ES)

(73) Assignee: Otis Elevator Company, Farmington, CT (US)

( * ) Notice: Subject to any disclaimer, the term of this patent is extended or adjusted under 35 U.S.C. 154(b) by 494 days.

(21) Appl. No.: 12/375,434

(22) PCT Filed: Aug. 15, 2006

(86) PCT No.: PCT/US2006/031754

§ 371 (c)(1),
(2), (4) Date: Jan. 28, 2009

(87) PCT Pub. No.: WO2008/020835

PCT Pub. Date: Feb. 21, 2008

(65) Prior Publication Data

US 2010/0000824 A1 Jan. 7, 2010

(51) Int. Cl.
*B66B 1/32* (2006.01)

(52) U.S. Cl. ..... 187/288; 187/414

(58) Field of Classification Search ..... 187/277, 187/250, 289, 351, 305, 373, 251, 288; 318/362, 318/370, 372; 188/72.1–72.3, 162, 363
See application file for complete search history.

(56) References Cited

U.S. PATENT DOCUMENTS

| | | | | |
|---|---|---|---|---|
| 4,059,339 | A * | 11/1977 | Brown | 359/461 |
| 5,048,626 | A * | 9/1991 | Strehler et al. | 180/19.2 |
| 6,681,898 | B1 * | 1/2004 | Doran | 187/277 |
| 7,140,475 | B1 * | 11/2006 | Appelqvist | 188/186 |
| 2006/0151254 | A1 | 7/2006 | Sevilleja-Perez et al. | |
| 2006/0169544 | A1 | 8/2006 | Fischer | |
| 2008/0132382 | A1 * | 6/2008 | Sturzer | 477/197 |

FOREIGN PATENT DOCUMENTS

| | | | |
|---|---|---|---|
| DE | EP1279638 | A1 | 1/2003 |
| EP | 0736477 | B1 | 5/2002 |
| JP | 2004075360 | A * | 3/2004 |
| WO | W02004107530 | | 12/2004 |

OTHER PUBLICATIONS

Search Report and Written Opinion mailed on Apr. 26, 2007 for PCT/US2006/031754.

* cited by examiner

*Primary Examiner* — Anthony Salata
(74) *Attorney, Agent, or Firm* — Carlson, Gaskey & Olds, P.C.

(57) ABSTRACT

An elevator machine (10) includes a machine shaft (14, 14') and a sheave (26) that rotates with the machine shaft (14, 14'). A motor (12) selectively rotates the machine shaft (14, 14'). A brake (30) having at least one brake armature (36) selectively moves a brake rotor (28) coupled for rotation with the shaft (14, 14') between a braking position and a released position. The brake rotor (28) selectively contacts a braking surface (44) formed directly on a housing (20, 22, 84, 90) to resist rotation of the machine shaft (14, 14').

10 Claims, 3 Drawing Sheets

ELEVATOR MACHINE WITH INTEGRATED BRAKE SURFACE

FIELD OF THE INVENTION

This invention generally relates to elevator systems and, more particularly, to elevator machine brakes.

DESCRIPTION OF THE RELATED ART

Many elevator systems include some form of load bearing member, such as a rope or a belt for supporting and moving the cab through a hoistway as desired. The load bearing member typically couples a counterweight to the cab. Typical geared or gearless arrangements include a motorized elevator machine that moves the load bearing member to move the cab through the hoistway.

One typical motorized elevator machine includes a machine shaft supported by a pair of bearing stands. Each bearing stand includes a bearing that rotationally supports the machine shaft. A motor rotationally drives the machine shaft. A sheave on the machine shaft between the bearing stands and rotates with the machine shaft. The ropes or belts are typically tracked through the sheave such that the motor may rotate the sheave in one direction to lower the cab and rotate the sheave in the opposite direction to raise the cab.

In such arrangements, the machine shaft typically extends beyond one of the bearing stands into a brake. A typical brake includes a fixed brake plate, an electromagnet, springs, a moveable brake armature, and a disk that rotates with the machine shaft. The disk extends between the fixed brake plate and the brake armature. The brake armature selectively clamps the disk between the brake armature and the fixed brake plate to hold the machine shaft and sheave when the cab is at a selected landing.

In one particular arrangement, the electromagnet, springs, and brake armature are contained in a brake housing that is secured to the fixed brake plate. This assembly is then secured to the bearing stand of the elevator machine Alternatively, the fixed brake plate is secured to the bearing stand using bolts and the electromagnet, springs, and brake armature are contained in a brake housing that is secured to the bearing stand with the disk between the brake armature and the fixed brake plate.

In another arrangement shown in EP 0 736 477 B1, an elevator brake includes a base and an electromagnet that are built into a housing outer wall section of an elevator machine or gearbox. Several fixed brake plates are supported on dowel pins that extend from the machine housing. An armature selectively clamps several disks that extend between the fixed brake plates together to resist rotation of a shaft.

Although such arrangements are effective for braking, those skilled in the art are always striving to improve performance, economies or both. There is a desire to simplify and reduce the manufacturing expense of elevator machine brakes.

SUMMARY OF THE INVENTION

One example elevator machine includes a machine shaft and a sheave that rotates with the machine shaft. A motor selectively rotates the machine shaft. A brake having at least one brake armature selectively moves a brake rotor coupled for rotation with the shaft between a braking position and a released position. The brake rotor selectively contacts a braking surface formed directly on a housing to resist rotation of the machine shaft in the braking position.

In one disclosed embodiment, the housing is a bearing stand having a bearing that rotationally supports the machine shaft and the bearing stand is a single, monolithic structure that provides the braking surface and supports the shaft.

In another disclosed embodiment, the housing is a gearbox housing. In another disclosed embodiment, the housing is a motor housing.

The various features and advantages of this invention will become apparent to those skilled in the art from the following detailed description. The drawings that accompany the detailed description can be briefly described as follows.

DETAILED DESCRIPTION

Figure 1:
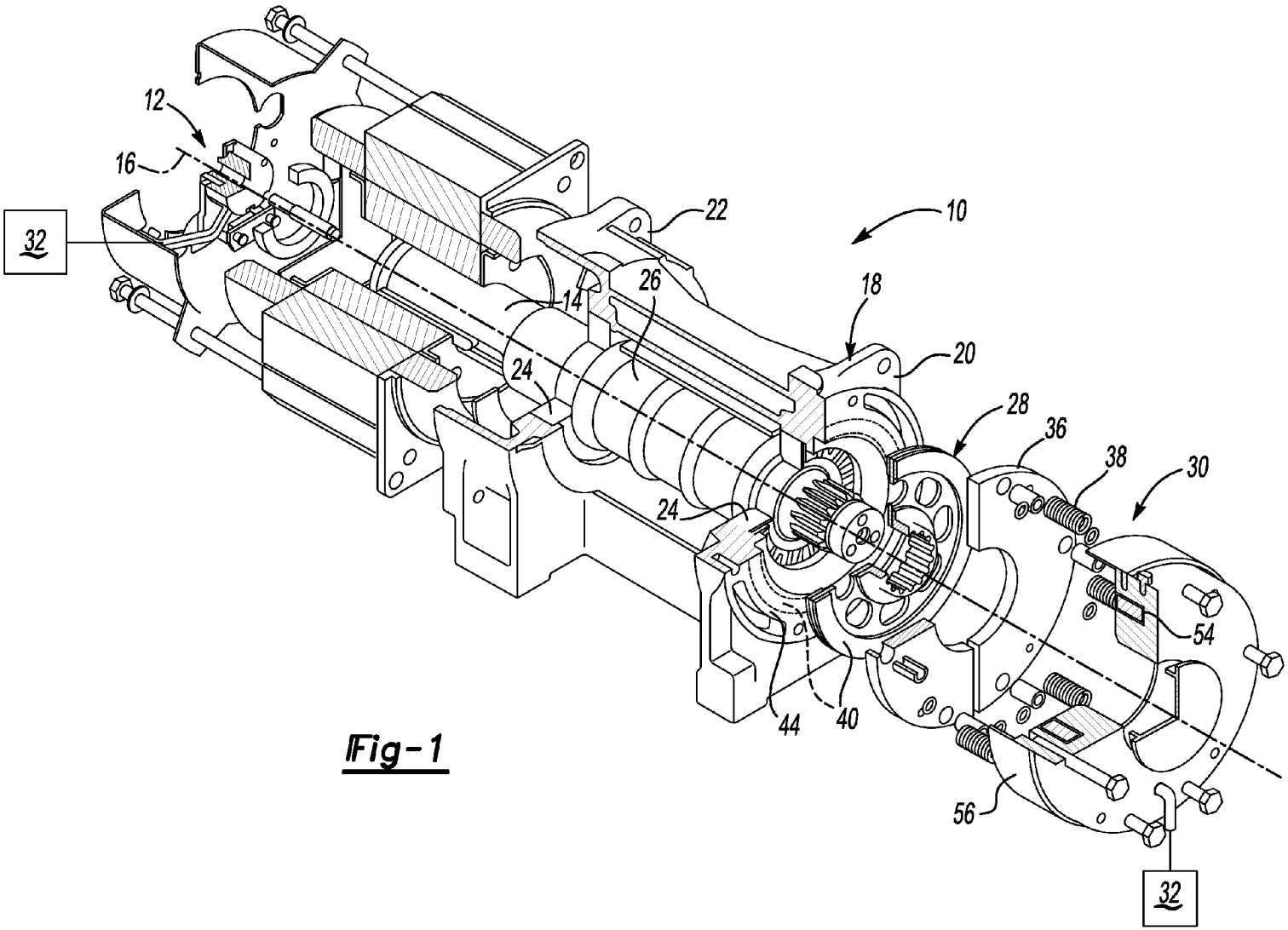
FIG. 1 illustrates selected portions of an example elevator machine that includes a housing having a braking surface.

FIG. 1 illustrates selected portions of an example elevator machine 10. In this example, the elevator machine 10 includes a motor 12 that rotationally drives a machine shaft 14 about an axis 16. In the arrangement shown, the machine 10 includes a housing 18 that supports the machine shaft 14. The housing 18 in this example, includes a first bearing stand 20 and a second bearing stand 22. Each bearing stand 20 and 22 includes a bearing 24 that rotationally supports the machine shaft 14 and generally prevents movement of the machine shaft in a direction perpendicular to the axis 16. The bearing stands 20 and 22 also provide structural integrity to the machine 10 assembly to transmit a portion of the load on the machine 10 to other elevator elements, such as a bedplate or brackets, which eventually distribute the load to the building structure. A sheave 26 on the machine shaft 14 between the bearing stands 20 and 22 rotates with the machine shaft 14 to raise or lower a cab in a known manner.

In this example, the machine shaft 14 extends through the first bearing stand 20 into an elevator brake assembly 30. The brake assembly 30 includes a rotor 28 that is coupled for rotation in a known manner with the machine shaft 14, such as with a splined connection. The brake assembly 30 selectively applies a braking force on the machine shaft 14 to prevent rotation of the machine shaft 14. A controller 32 selectively operates the motor 12 and the elevator brake assembly 30 to control movement of the cab.

Figure 2:
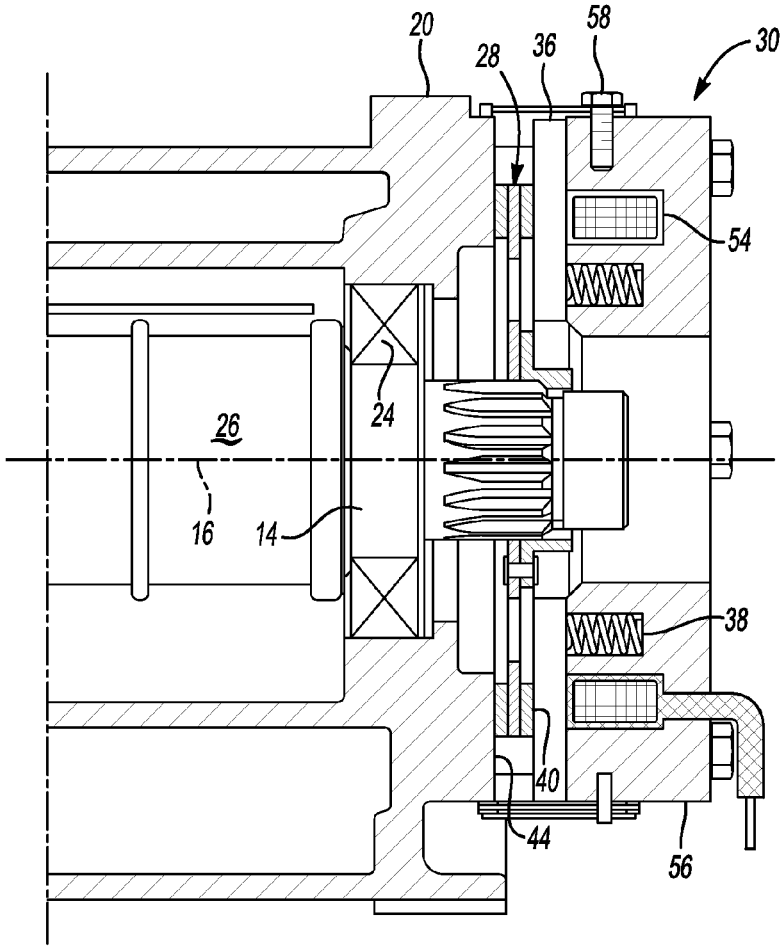
FIG. 2 illustrates selected portions of the brake shown in FIG. 1.

FIG. 2 illustrates a cross-section of the elevator brake assembly 30. In this example, the elevator machine brake 30 includes an armature 36 for clamping the rotor 28 to apply a braking force on the machine shaft 14. The armature 36 is shown in a split configuration in this example, however, a variety of known configurations other than a split armature can be used. Bias members 38 bias the armature 36 in a brake-applying direction toward the rotor 28.

In this example, the first bearing stand 20 includes a braking surface 44. The armature 36 clamps the rotor 28 against the braking surface 44 to resist rotation of the machine shaft 14. In the illustrated example, the rotor 28 includes brake linings 40 for wear resistance. One of the brake linings 40 in this example directly contacts the braking surface 44. Optionally, the brake lining 40 is on the braking surface 44 (shown in phantom in FIG. 1) instead of the rotor 28 to resist wearing the braking surface 40.

In this example, the braking surface 44 of the first bearing stand 20 is a flat surface. The braking surface 44 may be machined to achieve a desired level of flatness to promote uniform braking force distribution when the armature 36 clamps the rotor 28 against the braking surface 44. In another example, the braking surface 44 is an as-formed surface, such as from a casting process without the aid of machining. As can be appreciated, machining may be necessary to achieve a desired flatness tolerance. Given this description, one of ordinary skill in the art will recognize suitable methods for achieving a particular desired flatness.

The controller 32 selectively activates an electromagnet 54 to overcome the bias force provided by the bias members 38. In this example, when the machine shaft 14 starts rotating, the motion separates the rotor 28 from the braking surface 44 such that the rotor 28 rotates free from contact with the braking surface 44. Upon deactivation of the electromagnet 54, the bias members 38 actuate the armature 36 to again clamp the rotor 28 against the braking surface 44 of the first bearing stand 20. As can be-appreciated from this movement, the rotor 28 slides along the machine shaft 14 such that it is spaced from the braking surface 44 and rotor 28 when in a released position to allow free rotation.

In the illustrated example, the armature 36, bias members 38, and electromagnet 54 are retained in a housing 56 that is secured to the bearing stand 20 using fasteners 58 in this example.

As can be appreciated from FIGS. 1 and 2, the first bearing stand 20 is a single, monolithic structure that integrates several different components to achieve several different functions in the elevator machine 10. The term "monolithic" as used in this description refers to a single homogenous structure rather than an assembly of secured together pieces. In the disclosed example, the first bearing stand 20 is a single formed piece, such as a cast piece, that incorporates the braking surface 44 and supports the bearing 24. The integration of the braking surface 44 and the bearing 24 into the housing 18 provides the benefit of reducing the number of components in the elevator machine 10 by eliminating the need for a separate, fixed brake plate as typically used in known elevator machine brakes. By eliminating the fixed brake plate, the elevator machine 10 also has a smaller footprint compared to prior elevator machines.

Figure 3:
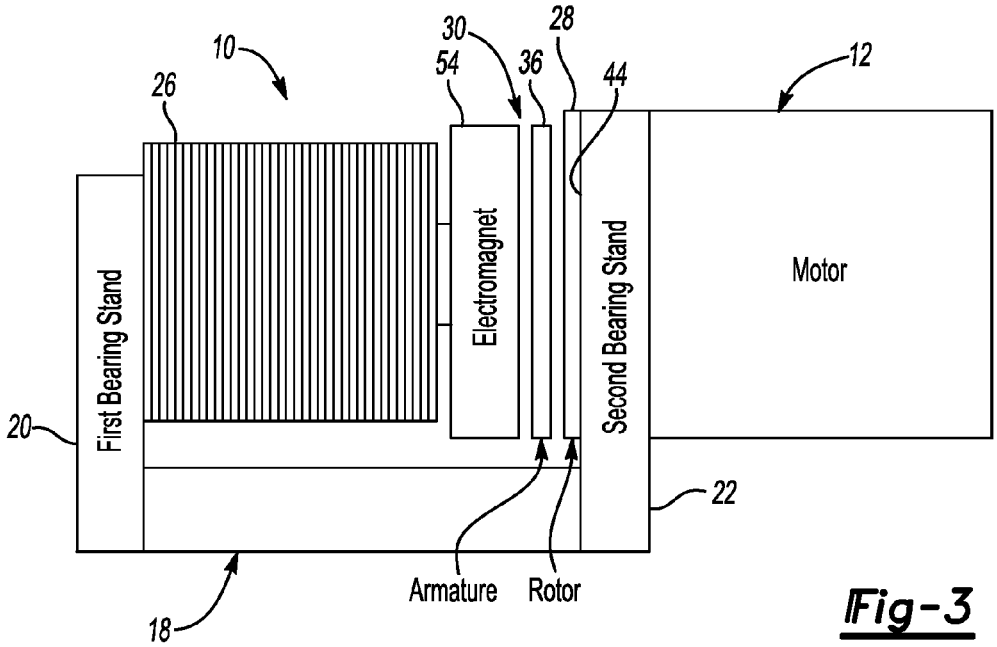
FIG. 3 illustrates a second example elevator machine that includes a housing having a braking surface.

FIG. 3 shows a simplified illustration of a modified embodiment. In this example, the braking surface 44 is located on the second bearing stand 22 instead of the first bearing stand 20 as in the example shown in FIGS. 1 and 2. The brake assembly 30 is also between the bearing stands 20 and 22 such that the braking surface 44 faces toward the first bearing stand 20. The braking surface 44 of this example provides similar benefits as the example shown in FIGS. 1 and 2.

Figure 4:
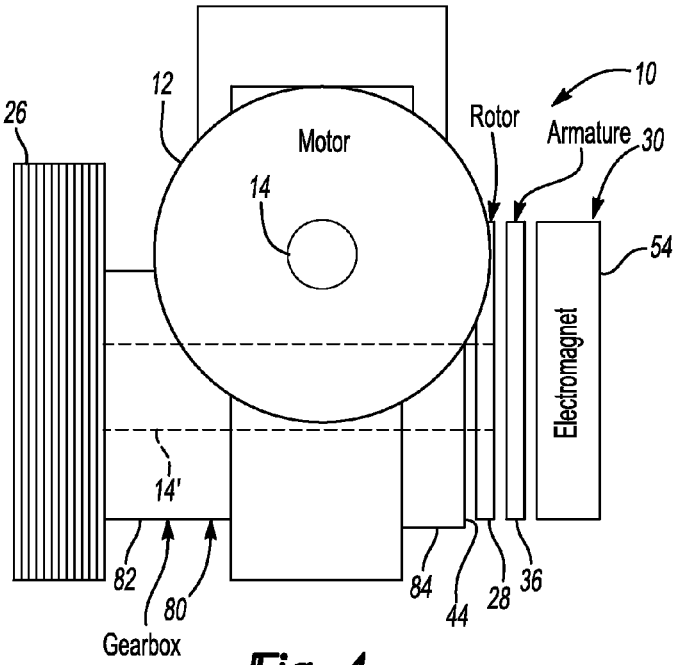
FIG. 4 illustrates a third example elevator machine that includes a housing having a braking surface.

FIG. 4 shows a simplified illustration of another modified embodiment. In this example, the machine 10 is a geared machine that includes a gearbox 80. The gearbox 80 includes a gear set 82 (shown schematically) that couples the shaft 14 (a motor shaft in this example) with an output shaft 14' on which the sheave 26 is disposed in a known manner. A gearbox housing 84 encloses the gear set 82 to shield it from the environment. In this example, the gearbox housing 84 includes the braking surface 44 for resisting rotation of the output shaft 14' in a similar manner as previously described. Alternatively, the brake assembly 30 is attached to the motor 12 and acts on the shaft 14 (similar to FIG. 5). The braking surface 44 of this example provides similar benefits as the example shown in FIGS. 1 and 2.

Figure 5:
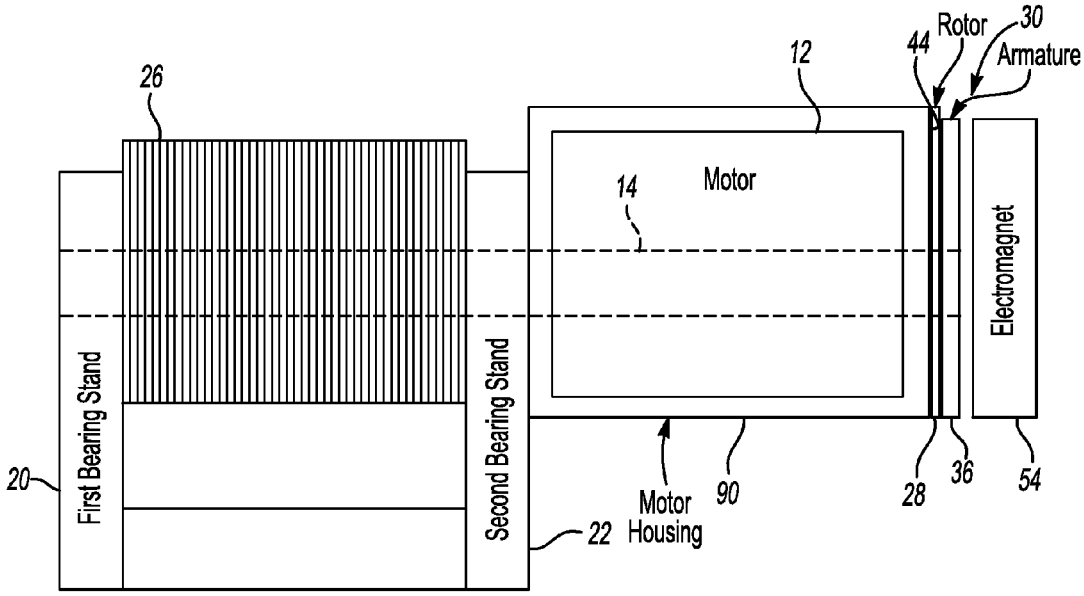
FIG. 5 illustrates a fourth example elevator machine that includes a housing having a braking surface.

FIG. 5 shows a simplified illustration of another modified embodiment. In this example, the brake assembly 30 is located on the other end of the shaft 14 than in the example illustrated in FIGS. 1 and 2. A motor housing 90 that encloses the motor 12 to shield it from the environment includes the braking surface 44 for resisting rotation of the shaft 14 as previously described. The braking surface 44 of this example provides similar benefits as the example shown in FIGS. 1 and 2.

As can be appreciated from the disclosed examples, the braking surface 44 can be integrated into a variety of different types of housings in a variety of different elevator machine 10 arrangements. Although the disclosed examples show particular housings in particular arrangements, the principles and beneficial features demonstrated by the disclosed examples, alone or in combination, are not limited to the disclosed embodiments.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

We claim:

1. An elevator machine comprising:

a machine shaft;

a sheave that is rotatable with the machine shaft;

a motor for selectively rotating the machine shaft;

a brake having at least one brake armature that selectively moves a brake rotor coupled for rotation with the shaft between a braking position and a released position; and a housing that includes a braking surface formed directly thereon for resisting rotation of the machine shaft when the brake rotor is in the braking position, the housing including a bearing stand assembly having a first bearing stand and a second bearing stand that includes the braking surface such that the braking surface faces in a direction toward the first bearing stand.

2. The machine as recited in claim 1, wherein the bearing stand assembly is a single, monolithic structure that provides the braking surface and supports the machine shaft.

3. The machine as recited in claim 1, wherein the machine shaft extends between the bearing stands and beyond each of the bearing stands such that each end of the machine shaft is cantilevered from, respectively, the first bearing stand and the second bearing stand.

4. The machine as recited in claim 1, wherein machine shaft is cantilevered from the at least one bearing stand.

5. The machine as recited in claim 1, comprising a brake lining on the braking surface.

6. The machine as recited in claim 1, comprising a brake lining on the brake rotor.

7. The machine as recited in claim 1, wherein the machine shaft comprises an output shaft.

8. The machine as recited in claim 1, wherein the machine shaft comprises a motor shaft.

9. The machine as recited in claim 1, wherein the machine shaft extends between the bearing stands, and the brake and the sheave are located between the bearing stands.

10. The machine as recited in claim 1, wherein the motor is outside of the volume between the bearing stands.

* * * * *